US006142075A

United States Patent [19]

Koch et al.

[11] Patent Number: 6,142,075

[45] **Date of Patent: *Nov. 7, 2000**

[54] METHOD AND APPARATUS FOR THE FORMATION OF EXACT PILES

[75] Inventors: Michael Koch, Cossebaude; Volker Taschenberger; Hans Zimmermann, both of Coswig, all of Germany

[73] Assignee: KBA-Planeta AG, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/081,871

[22] Filed: May 20, 1998

[30] Foreign Application Priority Data

May 31, 1997 [DE] Germany ..... 197 22 956

[51] Int. Cl.[7] ..... B41F 13/64

[52] U.S. Cl. ..... 101/238; 271/213; 271/214; 271/220; 414/790.2

[58] Field of Search ..... 101/240, 236, 101/237, 238, 239; 271/220, 221, 307, 198, 211, 213, 214; 414/788.1, 788.9, 789.1, 790.8, 790, 790.1, 790.2, 792.7

[56] References Cited

U.S. PATENT DOCUMENTS

| | | | |
|---|---|---|---|
| 694,850 | 3/1902 | French | 101/240 |
| 4,205,606 | 6/1980 | Jiruse | 101/240 |
| 4,296,684 | 10/1981 | Wangermann | 271/214 |
| 4,949,153 | 8/1990 | Claasew et al. | 271/213 |
| 5,026,034 | 6/1991 | Russel et al. | 271/214 |
| 5,249,793 | 10/1993 | Scheufler | 271/213 |
| 5,282,716 | 2/1994 | Prim | 414/789.1 |
| 5,360,315 | 11/1994 | Kurkowski et al. | 414/790.8 |
| 5,462,265 | 10/1995 | Mandel et al. | 414/790.2 |
| 5,617,784 | 4/1997 | John et al. | 100/3 |
| 5,671,920 | 9/1997 | Acquaviva et al. | 271/307 |
| 5,676,367 | 10/1997 | Oshino et al. | 271/214 |

FOREIGN PATENT DOCUMENTS 3403209 8/1984 Germany .

OTHER PUBLICATIONS

Xerox Disclosure Journal. "Sheet Stacker" vol. 4, No. 1, Jan./Feb. 1979 p 67.

Xerox Disclosure Journal "Variable Sheet Deflector for Document Restacking" vol. 6, No. 5 pp 237–238, Sep./Oct. 1981.

*Primary Examiner*—Eugene Eickholt

*Attorney, Agent, or Firm*—Gabriel P. Katona L.L.P.

[57] ABSTRACT

The invention relates to a method for exact pile formation in printing press deliveries, which comprises printing, or printing and coating sheets in a printing press, transporting the printed or printed and coated sheets to a sheet delivery pile, releasing the sheets above the delivery pile, compacting the delivery pile by applying mechanical or pneumatic pressure thereonto, and removing the thus compacted delivery pile, and to apparatus for carrying out the foregoing method.

22 Claims, 4 Drawing Sheets

METHOD AND APPARATUS FOR THE FORMATION OF EXACT PILES

FIELD OF INVENTION

The invention relates to method and apparatus for exact pile formation in printing press deliveries.

BACKGROUND OF INVENTION

In automated high-speed printing presses the pile of printed sheets loaded on a skid is changed immediately after reaching the final pile height. This process must be made without high acceleration forces and the pile should be formed in a stable and exact manner to prevent a pile slippage during pile lowering, raising and transportation and that high acceleration during pile movement should not cause pile slippage.

Air layers between the sheets established during piling are the main cause of pile instability. The air escapes after some time by itself due to the weight of the sheets. But with high production speeds of modern paper processing machines and the targeted short transportation distances the time is usually too short for venting the paper pile.

Therefore apparatus and methods are known for speeding pile venting before or during the transportation.

An apparatus is described in German patent No. 3,403,209 A1 for eliminating air inclusions by a smoothing tool shaped as a brush or roller for removal of trapped air below the smoothing tool during the pile movement transporting apparatus. A disadvantage of this apparatus is that it can be only used when the pile is moved. The possibility of a pile slippage cannot be fully eliminated until the material is compacted. Therefore this apparatus does not provide any suggestion as to measures for removing a pile from the delivery of a printing press without slippage of the pile.

SUMMARY DESCRIPTION OF INVENTION

It is an object of the present invention to influence the pile formation in printing press deliveries in a way that enables the pile transportation without slippage immediately after the pile is finished even when high acceleration forces are employed.

The invention involves a method for exact pile formation in printing press deliveries, which comprises printing, or printing and coating sheets in a printing press, transporting the printed or printed and coated sheets to a sheet delivery pile, releasing the sheets above the delivery pile, compacting the delivery pile by applying mechanical or pneumatic pressure thereonto, and removing the thus compacted delivery pile. The present invention further relates to mechanical and pneumatic apparatus for carrying out the foregoing method.

The method and the apparatus of the present patent have the advantage that every sheet in the delivered pile is compacted immediately after the end of the pile formation. This assures secure pile transport without slippage of sheets in the pile.

The compaction of the delivery pile results from pneumatic or mechanic means which operating from above the delivery pile and push air inclusions out. The pneumatic means have the advantage to operate in a contactless manner, while the mechanical means operate in a more time efficient manner.

BRIEF DESCRIPTION OF DRAWING

The invention is described below in greater detail, by reference being had to the drawing, wherein.

DETAILED DESCRIPTION

Figure 1:
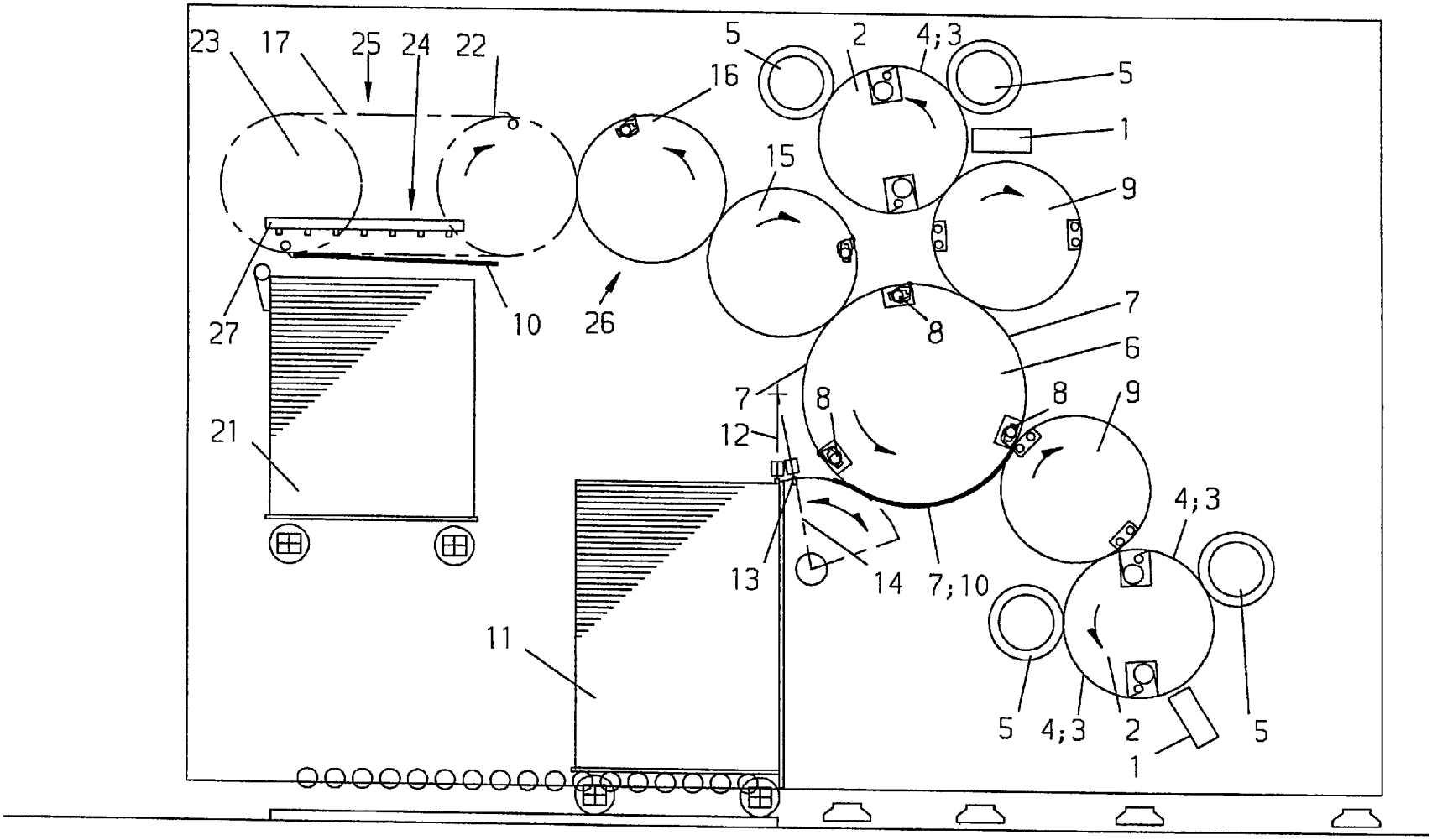
FIG. 1 is a schematic drawing of a printing press with a delivery pile

FIG. 1 shows a suitable embodiment of a printing press with a writing device 1 on a printing form 3 mounted on a printing form cylinder 2. The printing form cylinder 2 has two operating surfaces 4 each carrying one printing form 3. The printing form cylinder 2 is in contact with two inking and dampening systems 5 which are alternately switched on and off. The printing form cylinder 2 is in operating contact with an impression cylinder 6 through two surfaces of a blanket cylinder 9. The impression cylinder 6 has three impression surfaces 7 and therefore three gripper rows 8 for holding the sheets 10 to be printed. A second formation of blanket cylinder 9, printing form cylinder 2, inking and dampening system 5 and writing device 1 is adjacent to the impression cylinder 6. Transporting elements 12 are located above the feeder pile 11 for the movement of the sheets 10 to be printed from a feeder pile 11 to feed line 13. A transporting mechanisms 14 is used for moving the sheets 10 to be printed from the feed line 13 to the impression cylinder 6. A sheet delivery system 26 of two transfer drums 15, 16 and a sheet delivery 25 follows the impression cylinder 6. The sheet delivery 25 includes a delivery chain circuit 17 guided around the front and the back sprocket wheel 22, 23 and the delivery pile 21 below the delivery chain circuit 17. A pile compactor 24 is arranged above the sheet travel and the delivery pile 21 in the sheet delivery 25.

The printing machine is designed so that the sheet 10 to be printed is completely printed after two revolutions of the impression cylinder 6. Thus, for example, a four color print requires two revolutions of the impression cylinder 6. Only every second gripper 8 of the impression cylinder 6 carries a sheet 10 and only every second sheet will be delivered through the sheet delivery system 26.

The pile compacting apparatus is shown in FIG. 1 has a sheet delivery 25 which can follow, for example, a digital printing press, however, the application of the pile compactor 24 is not limited to such types of printing presses. It is also possible to arrange the pile compactor 24 in every kind of sheet delivery 25 of a printing press, independently of the configuration of the printing units of the printing press, or in every other kind of sheet processing machine, such as e.g. in coating machines with pile formation.

FIGS. 2 to 8 show various embodiments of the pile compactor apparatus 24, operating contactless with pneumatic means (FIGS. 2, 3, 4 and 8), or mechanically (FIGS. 5 to 7) at the delivery pile.

Figure 2:
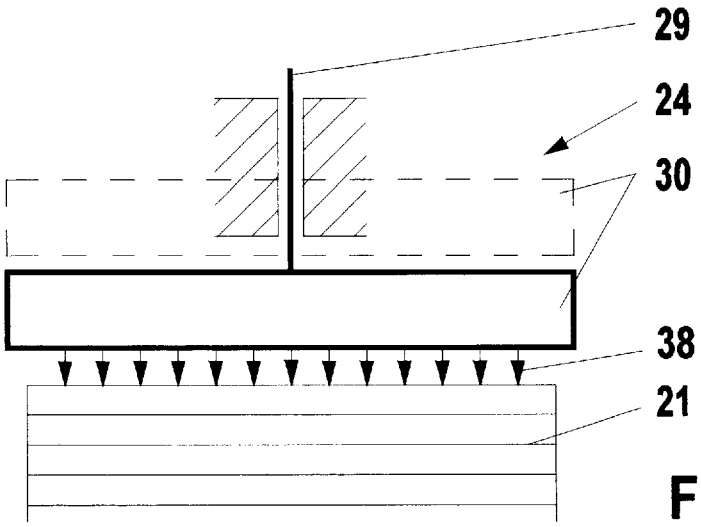
FIG. 2 is a first embodiment of an apparatus for contactless pile compaction.

FIGS. 2 to 7 show a cross-sectional front view of a delivery pile with the invention shown schematically without the elements that do not strictly belong to the pile compactor apparatus 24. The pile compactor 24 shown in FIG. 2 has a blow chamber 30 mounted at a slide guide. The blow chamber 30 is connected to a source of air (not shown). The blow chamber 30 is located above the delivery pile 21. Blowholes for blowing jets 38 point in the direction of the delivery pile 21. FIG. 2 shows the blow chamber 30 in a second position shown in a broken line. In its working or blowing position (shown in solid lines), and in its nonoperating, resting position (shown in the broken line) where the blow chamber 30 does not receive any blowing air.

Figure 3:
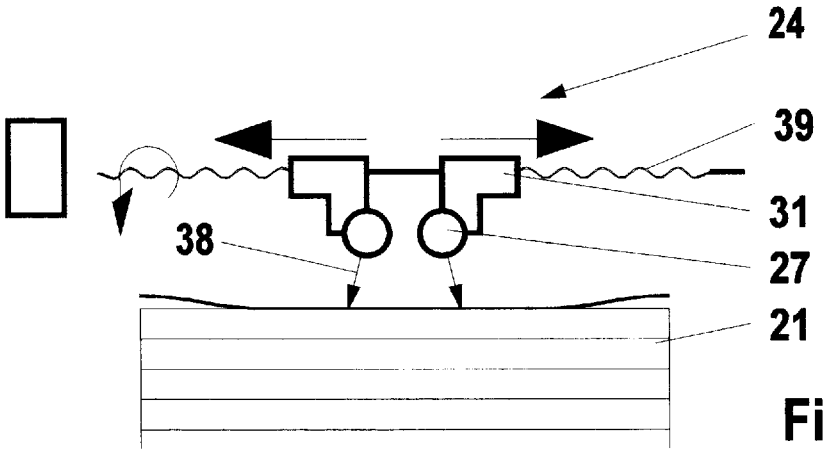
FIG. 3 is a second embodiment of an apparatus for contactless pile compaction.

In the application shown in FIG. 3 the pile compactor apparatus 24 has blow pipes 27 arranged symmetrically to the center 28 of the delivery pile 21. The blowing jets 38 of the blow pipes 27 are directed toward the outside. The blow pipes 27 are mounted on a slider 31 movable with a lead screw 39, thus enabling moving the blow pipes 27 in the range of the pile edges.

Figure 4:
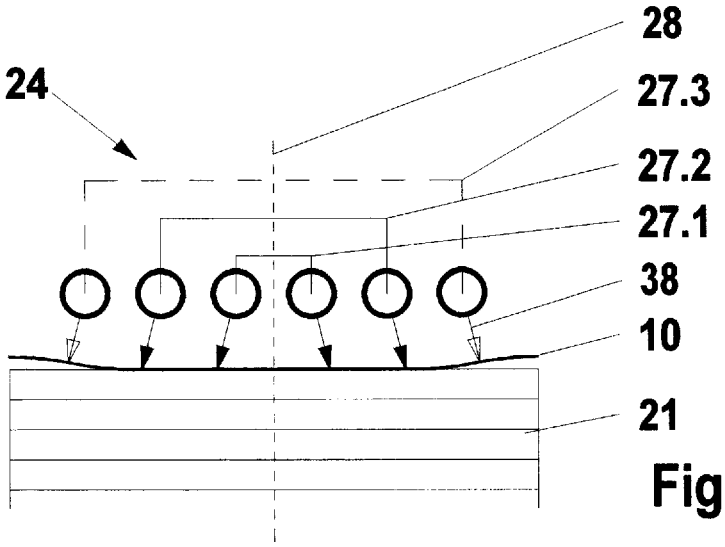
FIG. 4 is a third embodiment of an apparatus for contactless pile compaction.

The pile compactor apparatus 24 of to FIG. 4 has at least two pairs of blow pipes 27 (FIG. 4 shows three pairs of blow pipes) with their blowing jets 38 directed to blow outwardly. Each pair of blow pipes 27.1 to 27.3 is at the same distance from the center 28 of the delivery pile 21. Each pair of blow pipes 27 can receive a different amount of blowing air.

Figure 5:
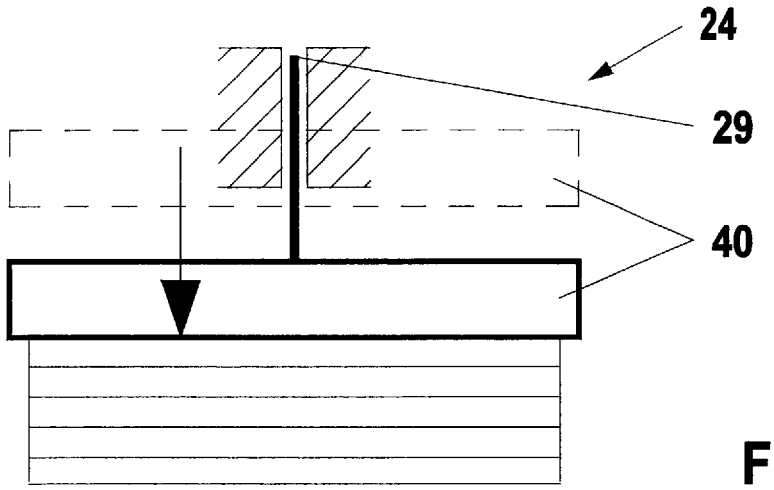
FIG. 5 is a first embodiment of an apparatus for mechanical pile compaction.

FIG. 5 shows a pile compactor apparatus 24 having a pressure plate 40 arranged on a slide bar 29. The pressing, or working position (shown in solid lines), and the resting position (shown in broken lines) can be controlled.

Figure 6:
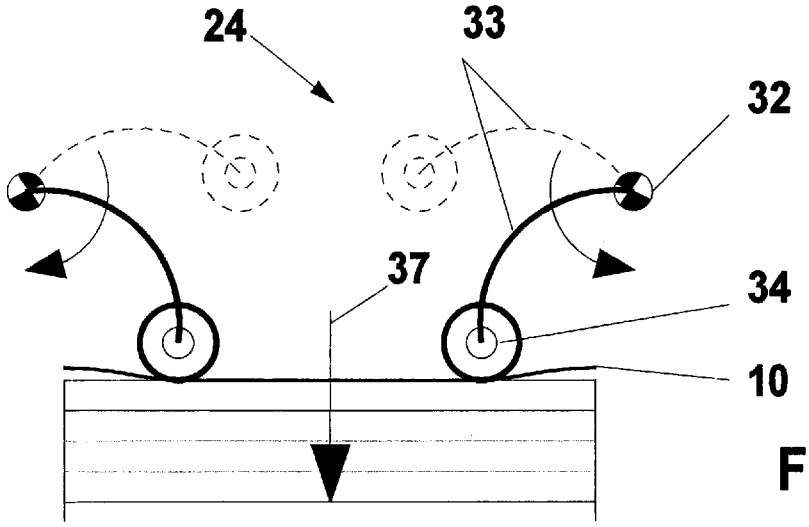
FIG. 6 is a second embodiment of an apparatus for mechanical pile compaction.

FIG. 6 shows a pile compactor 24 having a pair of pressure rollers 34 mounted on a lever 33 having a pivot point 32. FIG. 6 shows the pressure roller 34 in two positions, wherein the broken line position is the resting position, and the position shown in solid lines is the working position. Swiveling of the lever 33 occurs simultaneously with the lowering of the delivery pile 21. The lowering direction 37 is indicated by an arrow.

Figure 7:
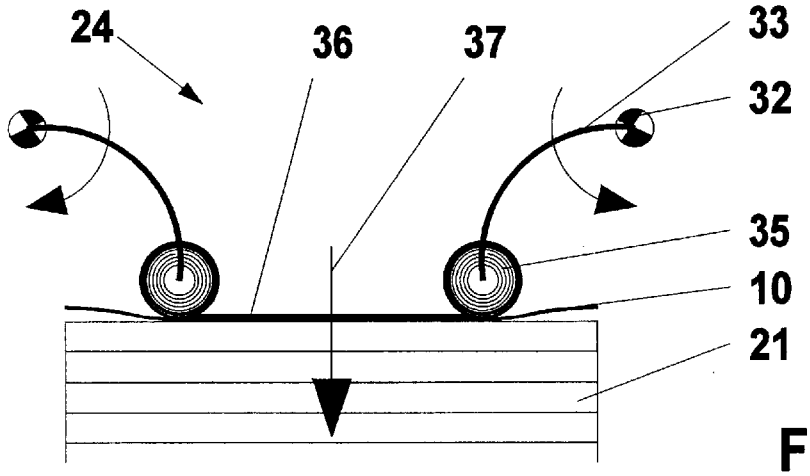
FIG. 7 is a third embodiment of an apparatus for mechanical pile compaction.

FIG. 7 shows a similar embodiment of the pile compactor apparatus 24 as in FIG. 6. In this last embodiment a pair of winding rolls 35 are used, mounted from a lever 33. A blanket 36 connects both winding rolls 35.

Figure 8:
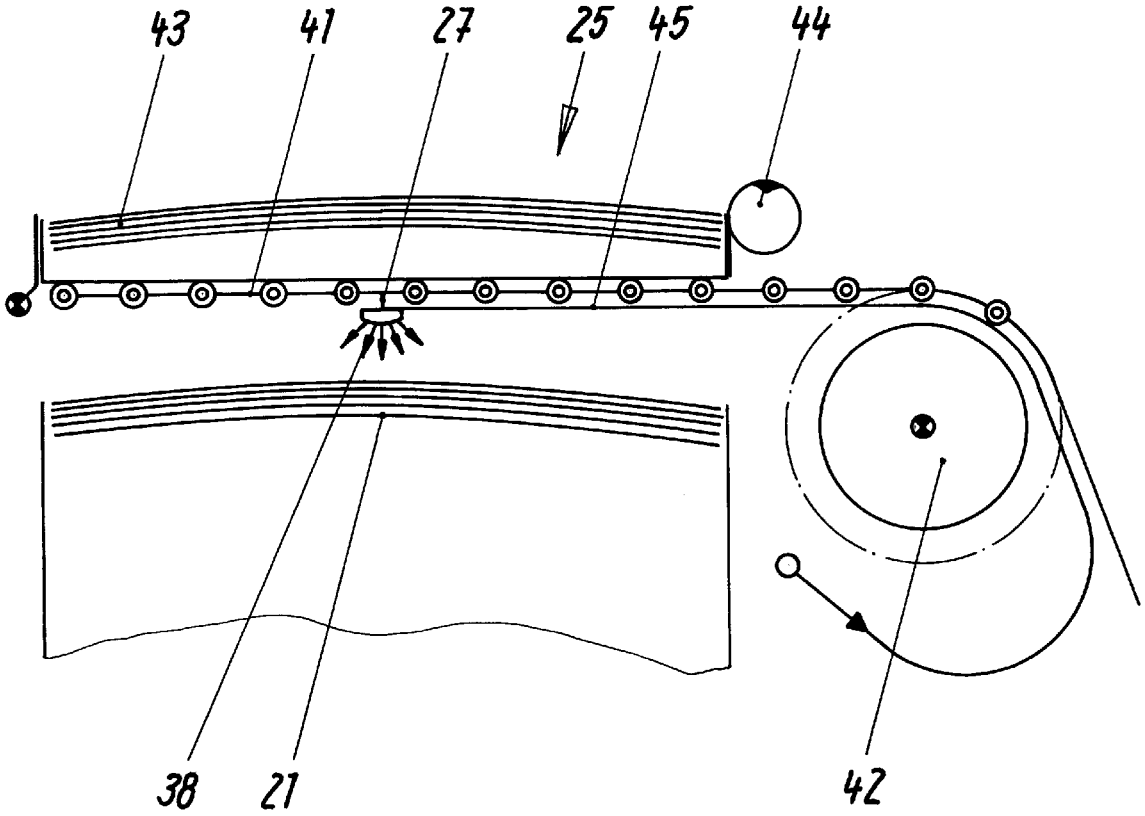
FIG. 8 is an apparatus for pile compaction in combination with an auxiliary pile table.

Another embodiment of the pile compactor 24 is shown in FIG. 8, with the side view of the sheet delivery 25. This embodiment of the pile compactor apparatus 24 works with an auxiliary pile table, in this case a non-stop cage 41. A drive wheel 42 drives the non-stop cage 41. FIG. 8 also shows an auxiliary pile 43 formed on the non-stop cage 41, as well as a suction wheel 44. A blow pipe 27 is transversely mounted at the non-stop cage in the middle of the delivery pile 21. The blowing jets 38 of the blow pipe 27 are directed toward the delivery pile. The blow pipe 27 is connected to a flexible air supply line 45 guided around the drive wheel 42.

In the process of the present invention the sheet 10 to be printed is separated from the feeder pile 11 and is fed by transporting elements 12 to the feed line 13 of the printing press and is transferred by the transportation mechanism 14 to one of the gripper rows 8 of the impression cylinder 6. Only every second gripper row 8 which passes the transportation mechanism 14, receives a sheet 10. The printing image is produced by the writing device 1 on the printing form 3 mounted at the printing form cylinder 2. The printing image is inked by the inking and dampening system 5 and is transferred to the blanket cylinder 9 which transfers the printing image to the sheet 10 at the impression cylinder 6. The first and second colors are transferred to the sheet 10 in the first revolution. The sheet 10 is carried at the impression cylinder 6 for a further full revolution to receive the third and forth colors.

After this the sheet 10 is transferred to the first transfer drum 15 and through the second transfer drum 16 to the delivery chain circuit 17 and to the delivery pile 21. If the pile formation occurs in a conventional machine the sheet 10 is printed in the printing units with the corresponding single colors and is transported to the sheet delivery 25 and is released above the delivery pile 21.

In the compaction method of the present invention for the delivery pile 21 in the sheet delivery 25 the pile compactor 24 operates immediately after the last sheet 10 is delivered to the delivery pile 21 and is adjusted. The method employing blowing air is contactless, such as according to the embodiments of FIGS. 2 to 4 and FIG. 8. The blowing air acts upon the delivery pile 21 through the blowing jets 38 for a short time but with a high intensity.

In the embodiment of FIG. 2 the blow chamber 30 is moved across the pile surface and the delivery pile 21 is impinged directly with blowing air from the blow chamber 30. The blowing jets 38 blow onto the delivery pile 21 with a high intensity and cause the air between the sheets 10 to escape.

In the embodiment of FIG. 3 the compaction of the delivery pile 21 is accomplished by the blowing jets 38 exiting the blow pipes 27 starting in the center 28 of the delivery pile 21. After that the blow pipes 27 are moved outwardly on both sides by the slider 31 and the lead screw 39, as shown by the arrows, so that the air in the delivery pile 21 is pushed outwardly from the inside. The blowing pipes 27 are moved back from their outer to their inner positions to be ready for compacting of the next delivery pile 21. Line-wise smoothing achieves the pile compaction according to the embodiment of FIG. 3.

According to the embodiment in FIG. 4 pairs of blow pipes 27.1 to 27.3 are supplied with blowing air starting the sequence of the blow pipes from the inside toward the outside so that the air is pushed outwardly of the plane from the delivery pile 21.

The compaction of the delivery pile 21 according to the embodiment in FIG. 8 is done during non-stop pile change. The non-stop cage 41 is brought above the delivery pile 21 for a pile change, the position shown in FIG. 8. Simultaneously with the formation of an auxiliary pile 43 a blow pipe 27 is supplied with air through the air supply line 45 and its blowing jets 38 compact the delivery pile 21 from the center. After compaction the delivery pile 21 is taken from the sheet delivery 25 and the auxiliary pile 43 becomes the delivery pile 21 after removal of the non-stop cage 41.

The pile compactor 24 of the embodiments shown in FIGS. 5 to FIG. 7 operates mechanically. In the embodiment of FIG. 5 the pressure plate 40 is moved in a slide bar 29 toward the delivery pile 21 and is placed onto the delivery pile 21, so that pile compaction is accomplished by surface pressure by a plane compaction action.

In the pile compactor 24 shown in FIG. 6, the pressure rollers 34 are swiveled about their pivot point 32 from their resting positions shown in broken lines, into their working positions shown in solid lines to compact the delivery pile 21. As soon as the working position is reached and the pressure rollers 34 lie on the upper sheet 10 of the delivery pile 21, a simultaneous further swiveling of the pressure rollers 34 is started together with the lowering 37 of the delivery pile 21 to accomplish from the center of the pile outward compaction by line-wise action for causing the outward escape of air. This is ensured by a continuous pressing force of the pressure rollers 34 on the delivery pile 21, and also by the movement of the pressure rollers from the inside toward the outside. Both pressure rollers 34 are moved back into their resting position above the delivery pile 21 after the compaction is completed.

The pile compacting apparatus 24 shown in FIG. 7 operates in the same manner as the embodiment as shown in FIG. 6, with the only difference, that every lever 33 carries a winding roll 35, and both winding rolls 35 are connected with a blanket 36, which unwinds from the winding rolls 35 during compaction of the delivery pile 21 while the delivery pile 21 is being lowered, to prevent loosening of already compacted parts of the delivery pile 21, thus providing an increased plane compaction action.

We claim:

1. A method for exact pile formation in printing press deliveries, which comprises printing, or printing and coating sheets in a printing press, transporting the printed or printed and coated sheets to a sheet delivery pile of the printing press, releasing said sheets above the delivery pile, and upon completion of the pile compacting the delivery pile by applying mechanical or pneumatic pressure thereonto while optionally simultaneously lowering the pile, and removing the thus compacted delivery pile.

2. The method of claim 1, which comprises compacting the delivery pile without any mechanical contact therewith.

3. The method of claim 1, which comprises compacting the delivery pile by mechanically contacting it.

4. The method of claim 1, which comprises compacting the delivery pile by plane compaction action.

5. The method of claim 1, which comprises compacting the delivery pile by line-wise compaction.

6. The method of claim 1, which comprises compacting the delivery pile by increased plane compacting action.

7. Apparatus for exact pile formation in a printing press delivery, which comprises means for printing or printing and coating sheets, means for transporting said sheets to a delivery pile having a center, means for releasing the transported sheets above the delivery pile, means for laying down the released sheets onto the delivery pile, a pile compactor disposed above the delivery pile and movable downwardly toward said delivery pile for the compaction thereof upon the completion thereof, and optional means for lowering the pile during the compaction thereof.

8. The apparatus of claim 7, wherein the pile compactor is a pneumatic pile compactor.

9. The apparatus of claim 7, wherein the pile compactor is a mechanical pile compactor.

10. The apparatus of claim 8, wherein said pneumatic pile compactor comprises a blow chamber mounted from a slide guide, said blow chamber having a plurality of blowing holes, each of said blowing holes having a blowing jet.

11. The apparatus of claim 10, wherein said blowing jets are directed to blow air perpendicularly onto said delivery pile.

12. The apparatus of claim 8, which comprises at least two blowing pipes disposed substantially symmetrically to the center of the delivery pile, said blowing pipes each having a plurality of blowing jets for blowing air outwardly from said center, and a slider with a lead screw for vertically displacing said blowing pipes.

13. The apparatus of claim 12, further comprising a plurality of blowing pipes disposed about said center in addition to said at least two, wherein said blowing jets are disposed to direct air onto said delivery pile increasingly outwardly from said center.

14. The apparatus of claim 7, comprising a non-stop cage for movement in a direction transverse to the delivery pile, and a blowing pipe mounted at said non-stop cage for blowing air downwardly to said delivery pile and outwardly from said center thereof.

15. The apparatus of claim 14, further comprising an air supply line for delivering air to said blowing pipe.

16. The apparatus of claim 15, wherein sheet delivery takes place to an auxiliary pile, and upon the compacting and removal of said delivery pile said auxiliary pile becomes said delivery pile.

17. The apparatus of claim 7, wherein said pile compactor comprises a pressure plate for pressing said delivery pile, and a side bar for movably mounting said pressure plate therefrom.

18. The apparatus of claim 7, wherein said pile compactor comprises a pair of pressure rollers, and a lever each mounting one of said pressure rollers for swiveling toward and away from said delivery pile.

19. The apparatus of claim 18, wherein each of said pressure rollers is adapted to be moved from a more central surface portion of said delivery pile outwardly toward the edge thereof while said delivery pile is being lowered.

20. The apparatus of claim 9, wherein said mechanical pile compactor comprises a pair of swivelable levers each having an end that is swingable to a position above said delivery pile, and a pressure roller rotatably mounted from said end of each of said levers for applying mechanical pressure to the top of said delivery pile and for rolling away from the other roller while the pile is being lowered during compacting.

21. The apparatus of claim 20, further comprising a wound blanket attached to said levers.

22. The apparatus of claim 21, wherein each of said pressure rollers is connected to the other by said blanket.

* * * * *